US006302788B1

(12) United States Patent
Gagnon

(10) Patent No.: US 6,302,788 B1
(45) Date of Patent: Oct. 16, 2001

(54) DRYER OUTDOOR VENT WITH REMOVABLE GRILL

(75) Inventor: Francois Gagnon, Moncton (CA)

(73) Assignee: Imperial Sheet Metal, Ltd., Richibucto (CA)

( * ) Notice: Subject to any disclaimer, the term of this patent is extended or adjusted under 35 U.S.C. 154(b) by 0 days.

(21) Appl. No.: 09/602,939

(22) Filed: Jun. 22, 2000

(51) Int. Cl.[7] ..... F24F 13/20
(52) U.S. Cl. ..... 454/367; 454/359
(58) Field of Search ..... 454/358, 367, 454/368; 55/507

(56) References Cited

U.S. PATENT DOCUMENTS 4,967,490 11/1990 Berger ..... 34/235
5,046,408 9/1991 Eugenio ..... 98/119
5,547,422 8/1996 Seboldt ..... 454/359
5,722,181 3/1998 Meyer ..... 34/235
5,916,023 6/1999 Meyer ..... 454/359

*Primary Examiner*—Harold Joyce
*Assistant Examiner*—Derek S. Boles
(74) *Attorney, Agent, or Firm*—Young & Basile, PC

(57) ABSTRACT

A clothes dryer exhaust vent comprises a vent hood and a detachable grill. The detachable grill fits within the vent hood opening. A snap-fit system is provided which allows one to grasp the exposed edges of the grill, squeeze inwardly and readily disengage the grill from the vent hood. This system avoids having to unscrew the grill, remove the clips or the like to provide for grill service.

5 Claims, 4 Drawing Sheets

54
52
16
18
54
12
44
10
48
20
38
30
42
50
36
34
28
40
26
64
72
24
58
54
62
70
66
14
60

18
20
46
24
36
38
42
56
22
16
68
32
74
62
72
64
14
66

18
20
56
36
38
72
32
14
66

DRYER OUTDOOR VENT WITH REMOVABLE GRILL

FIELD OF THE INVENTION

This invention relates to a clothes dryer vent which is particularly suited to venting the dryer exhaust outdoors while preventing animals from entering the vent.

BACKGROUND OF THE INVENTION

Exhaust vents have been provided for dryers for several years. Commonly, the exhaust vent includes a type of flapper valve which prevents cold air or hot air from entering the house through the dryer vent. An example of a dryer vent with flapper valve is described in U.S. Pat. No. 4,967,490. However, with the exterior vent animals can still enter the vent area and nest in those areas. U.S. Pat. No. 5,547,422 describes a cage-like guard which may be placed over the vent to preclude animals from entering the vent and nesting in the vent opening. However that system is quite bulky and can be damaged since it is mounted on the exterior of the home.

Protective grills or screens have been mounted in the exhaust vent, such as described in Canadian patent 2,111,157 and U.S. Pat. No. 5,046,408. The protective screens are clip-mounted in the vent or mounted in narrow channels. These arrangements are cumbersome and usually breakdown resulting in animals gaining access to the interior of the vent opening.

An attempt to overcome these problems has been provided with snap-fit type grills; for example, as described in Canadian patent application 2,232,659 and U.S. Pat. Nos. 5,722,181 and 5,916,023. Various arrangements are provided in snap-fitting the grill in place. In U.S. Pat. No. 5,722,181, the entire grill is snap-fitted to a base. However, it projects considerably from the exterior wall and can be readily knocked off. The grill of U.S. Pat. No. 5,916,023 is mounted at the base of the vent opening. However it is very difficult to remove from the exhaust vent hood, because the snap-fit projections engage the front wall of the hood. One has to use a screwdriver or the like to unclip the grill from the hood. This can result in breakage of the grill particularly at colder temperatures. The hinge-mounted grill, as described in Canadian patent application 2,232,659 is pivoted at its base and clips into the hood at its top. Again, particularly in cold weather, it is particularly difficult to disengage the grill. Normally a screwdriver is required to pry it out. When the grill falls down, it can be readily disengaged from its hinge connections which can result in breakage of the unit.

Applicant's invention overcomes a number of the above problems by providing a grill which is snap-fitted into a downwardly projecting opening of the vent hood, The grill interfits with the hood in a way that it can only be mounted in one direction in the hood. It can only be disengaged by squeezing the grill at its sides and thirdly, the detent system is arranged where such gentle squeezing of the grill provides for immediate disengagement of the grill from the hood.

SUMMARY OF THE INVENTION

In accordance with an aspect of the invention, a cloths dryer exhaust vent comprises:

i) a vent hood having a rear wall for attachment to a building exterior wall and defining a downwardly projecting rectangular shaped vent opening, the opening being defined in part by a reinforcing flange about hood opening perimeter, the flange having an interior surface about three sides of the opening, the fourth side of the opening being defined by the rear wall, the flange interior having on opposing interior sides stops and detent projections, the rear wall defining said fourth side of the opening and having a downwardly extending ridge, ii) a detachable grill for the vent hood opening which snap fits into the opening by engaging the interior surface of therein forcing flange, the grill having a three sided perimeter lip for fitment within the reinforcing flange, the fourth side of the grill having a depending lip for mating fit over the ridge of the rear wall, the grill having on opposing lip portion recesses for receiving the detent projections of the hood, the opposing lip portions having rear edges which engage the stops of the hood, the stops being positioned on the hood reinforcing flanges to locate the grill recesses to snap fit with the detents and provide for portions of the grill opposing lips to project outwardly of the hood flange, the outwardly projecting lip portions providing finger grip sections to permit grasping the grill opposing walls and by gentle inward pressure disengage the grill from the hood for cleaning, the grill depending lip matingly engaging the hood ridge providing for one-way fitment of the grill on reinstallation to the hood.

BRIEF DESCRIPTION OF THE DRAWINGS

Preferred embodiments of the invention are shown in the drawings; wherein.

DETAILED DESCRIPTION OF THE PREFERRED EMBODIMENTS

The clothes dryer exhaust vent of this invention provides a readily disconnectable grill which permits easy cleaning regardless of the outdoor temperatures. At the same time, the grill is not accessible and cannot become easily dislodged from the vent hood. The vent hood and grill have interfitting portions which ensure one way fitment of the grill to the hood. Such mating of the grill with the hood also directs a user to grasp the correct sides of the grill to disengage it from the hood.

Figure 1:
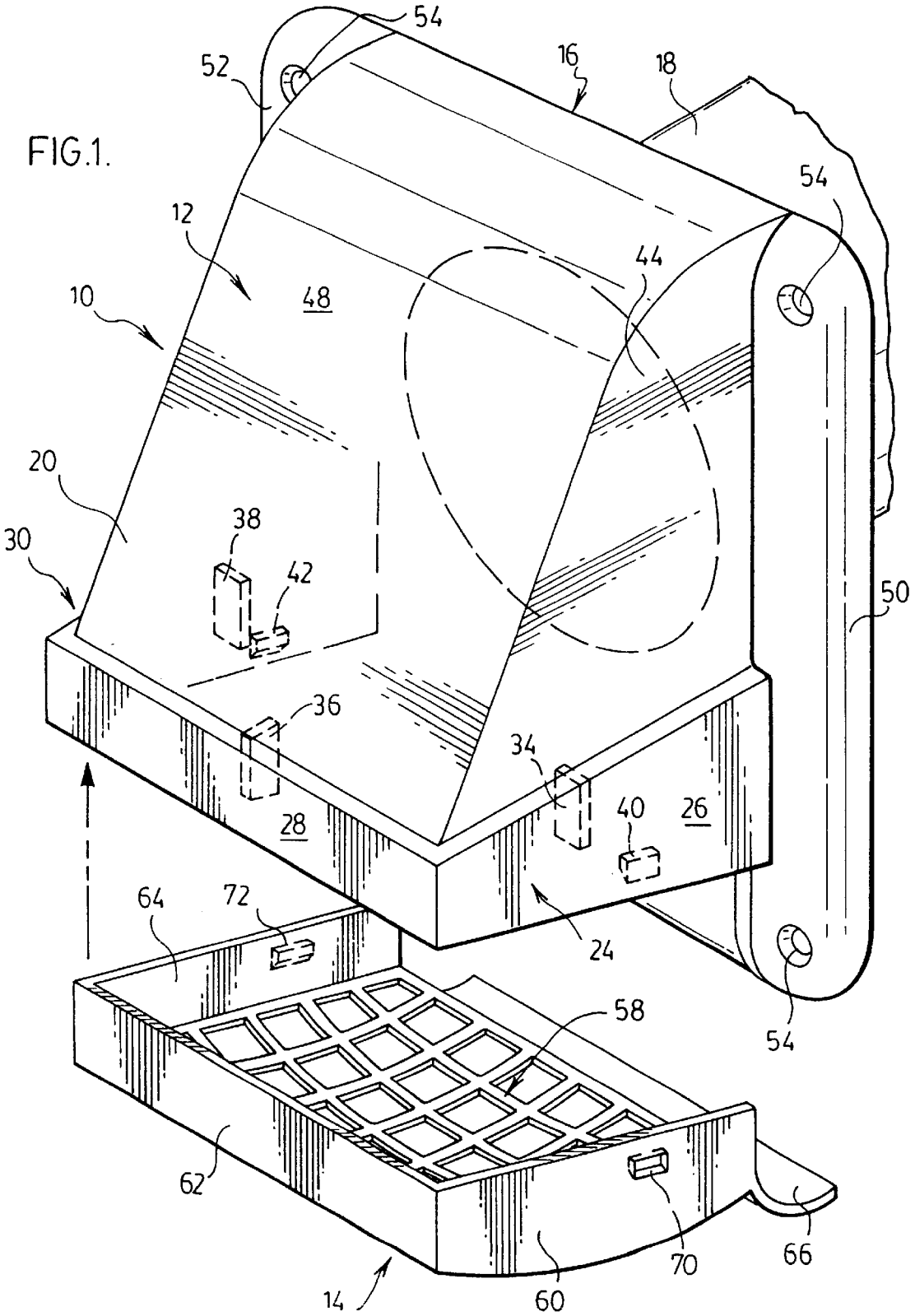
FIG. 1 is an exploded perspective view of the clothes dryer exhaust vent of this invention.
Figure 2:
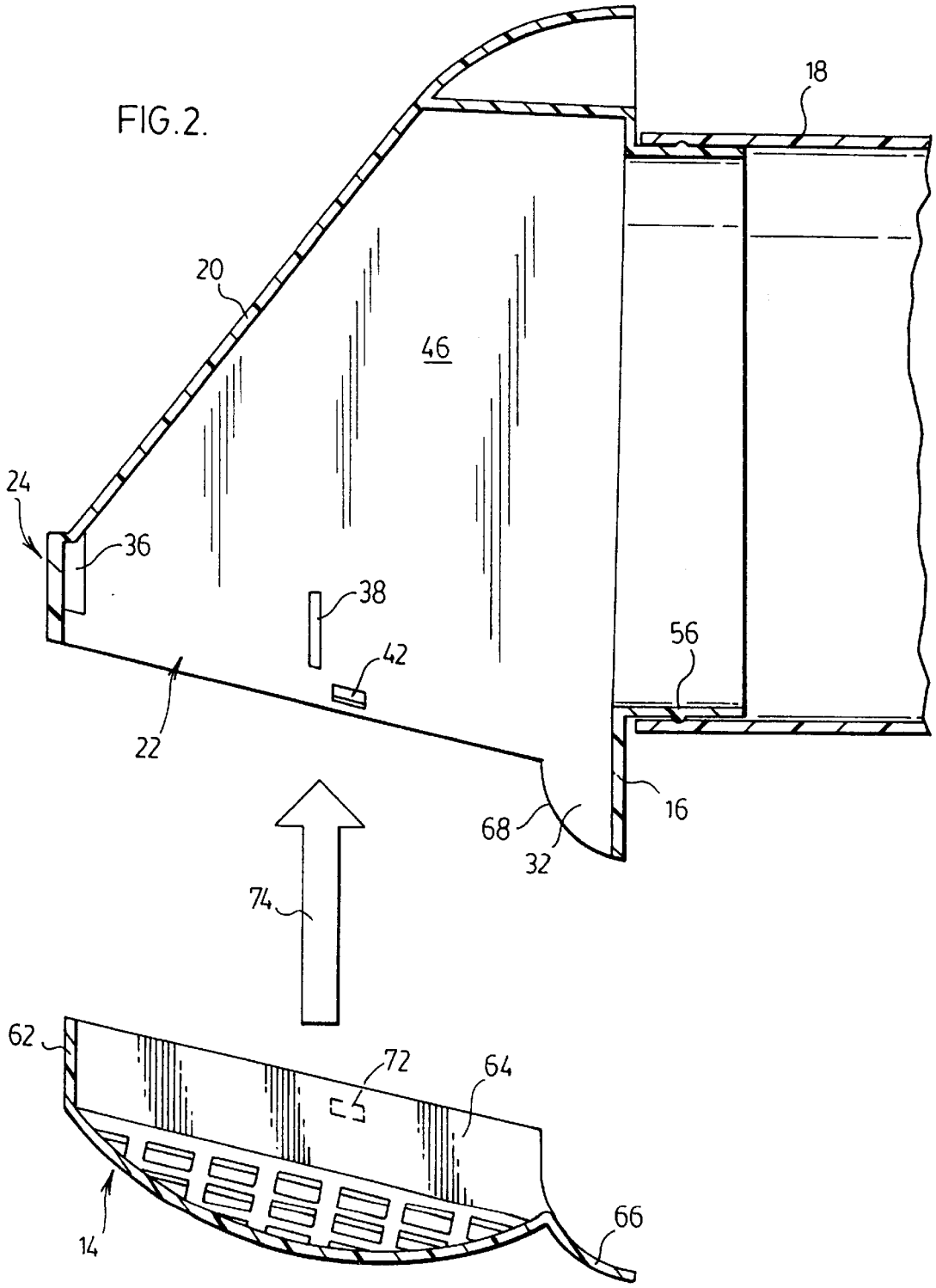
FIG. 2 is a section through the exploded view of FIG. 1.

With reference to FIGS. 1 and 2, the clothes dryer exhaust vent 10 comprises a hood 12 and a grill 14. The hood 12 has a rear wall generally designated 16 with a dryer exhaust vent ducting 18 connected or integrally formed therewith. The vent hood has a cover 20 integral with the rear wall 16. The vent hood 12 has a downwardly projecting opening 22. The opening is defined in part by a reinforcing flange 24 which has three wall portions 26, 28, and 30. The fourth side of the opening is defined by the rearwall 16 having a ridge portion 32. The reinforced flange has three separate stops 34, 36 and 38. In addition, the reinforced flange has opposing detent projections 40 and 42. The vent hood 12, as it is integral with the rearwall 16, has side portions 44 and 46 as well as front slopping portion 48. The rearwall includes rounded side members 50 and 52 which carry holes 54 to permit fastening of the hood rearwall and hence the hood assembly to an exterior building wall. The rearwall 16 is also equipped with a duct mounting flange 56 which is of a diameter to receive dryer exhaust vent ducting 18.

Figure 3:
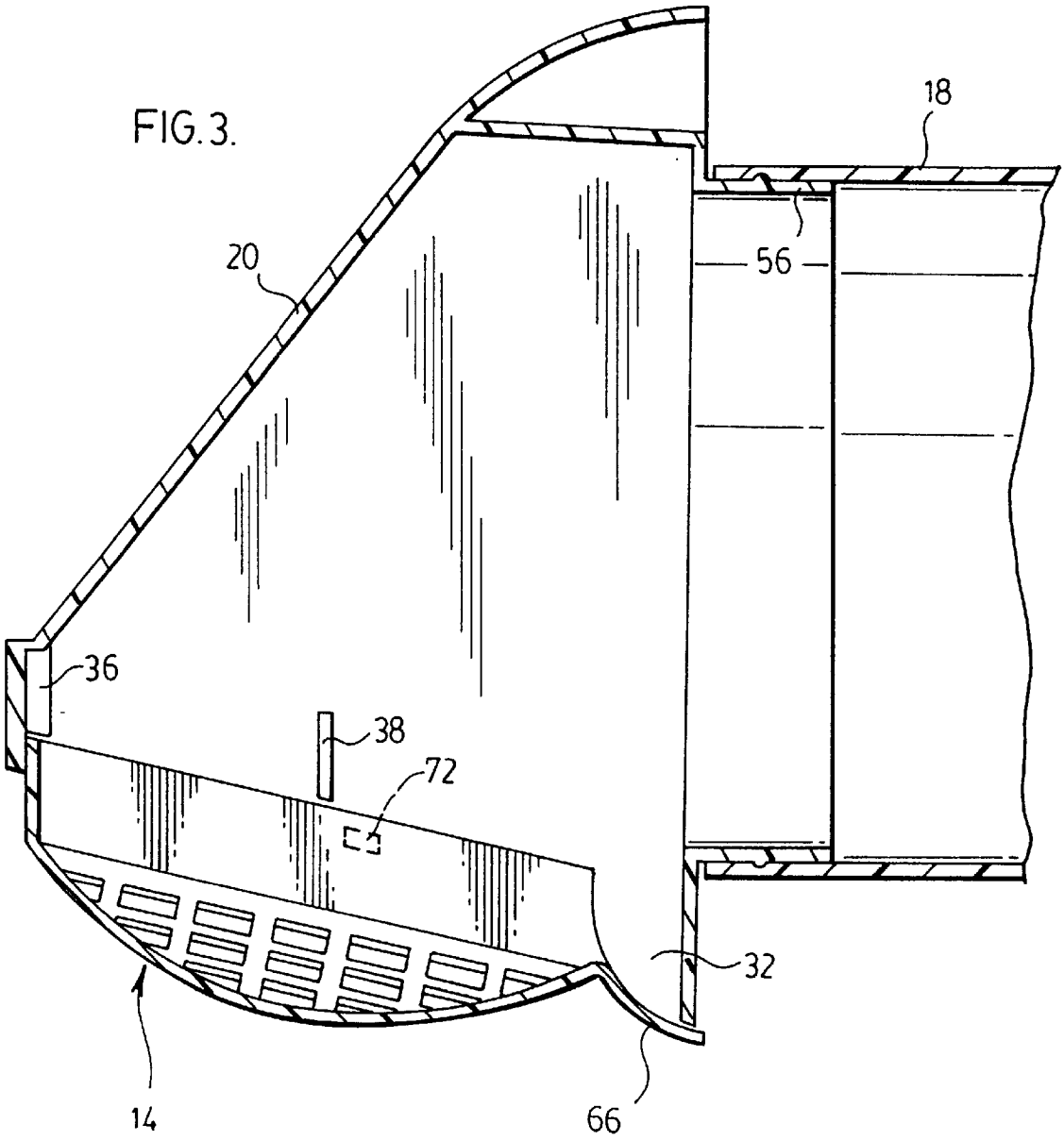
FIG. 3 is a section through the assembled vent hood of FIG. 1.

The grill 14 comprises a screen generally designated 58 which is integral with three sidewalls 60, 62 and 64. The bottom part of the grill is defined by a depending lip 66 which, in accordance with this particular embodiment, is curved to mate with the curved outer surface 68 of the ridge 32. The lip portions 60 and 64 carry recesses 70 and 72 which engage the respective detent projections 40 and 42 when the grill is snap-fitted in place on the vent hood. As shown in FIG. 2, the grill 14 is advanced in the direction of arrow 74 for interfitment within the vent hood. As shown in FIG. 3, the grill is assembled to the vent hood where the respective stops 34, 36 and 38 limit the extent of travel of the grill 14 into the vent hood opening 22, but at the same time, allows sufficient travel of the grill lips into the vent opening so that the recesses 70 and 72 engage the detent projections 40 and 42. Also as shown in FIG. 3, the curved lip 66 matingly engages the correspondingly curved ridge 32 to provide for the one-way orientation of the grill 14 on assembly to the hood.

Figure 4:
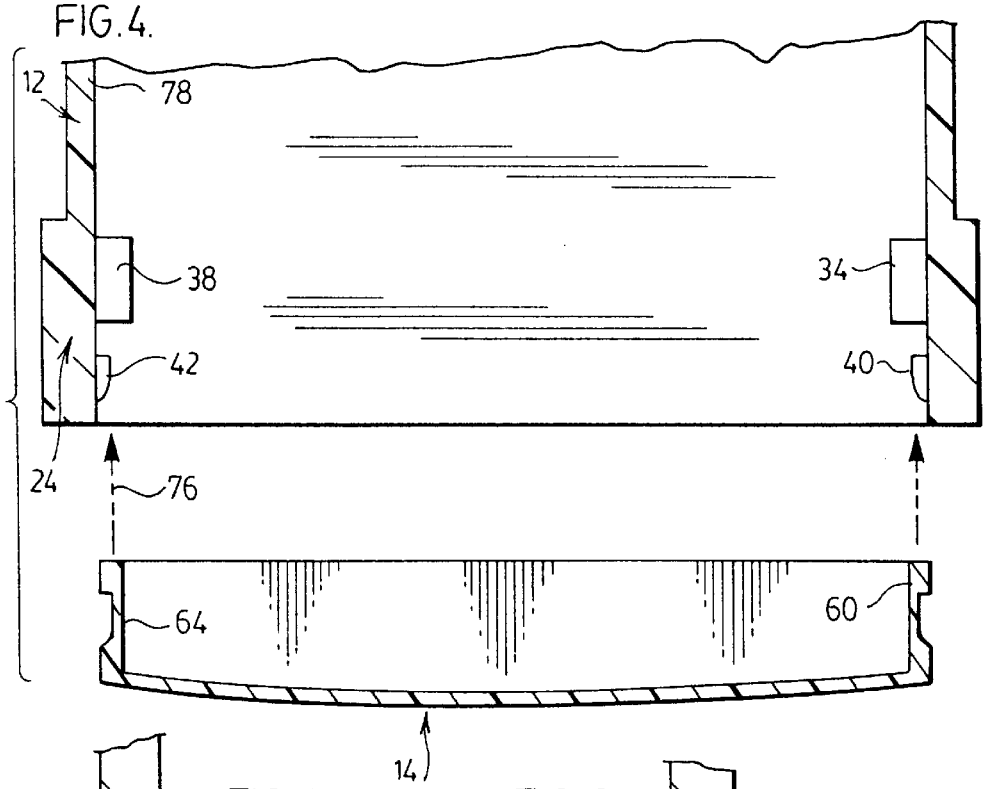
FIG. 4 is a top section of the grill to be mounted to the hood.

As shown in FIG. 4, the grill 14, as it is advanced towards the hood 12, engages the respective detents 40 and 42 where the stops 34 and 38 limit further inward travel in the direction of arrow 76. It is appreciated from FIG. 4 that the reinforcing flange 24 is considerably thicker than the balance of the wall portion 78 of the hood. This reinforcing flange prevents the hood from expanding and in turn forces the grill lips 60 and 64 to deform inwardly when the grill is snap fitted to the hood.

Figure 5:
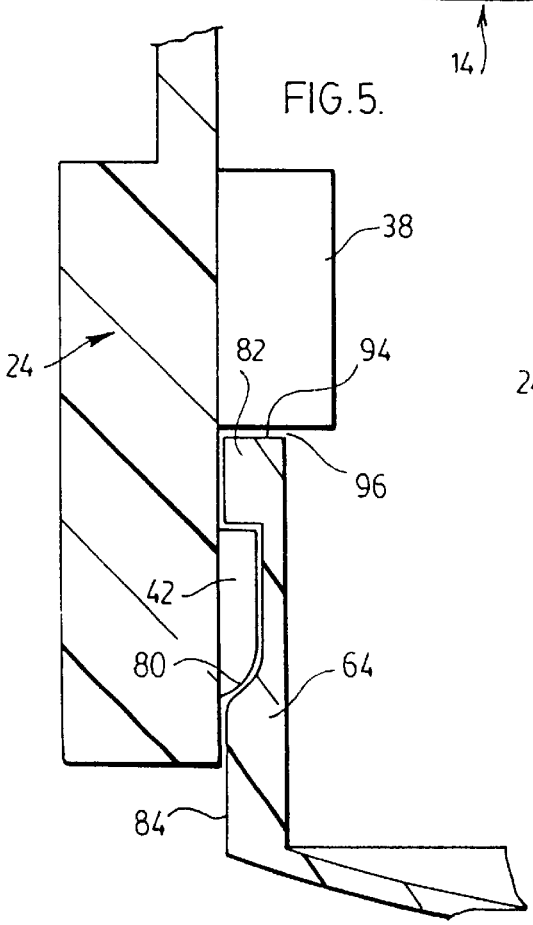
FIG. 5 shows the detent system engaged for fitting the grill to the hood.
Figure 6:
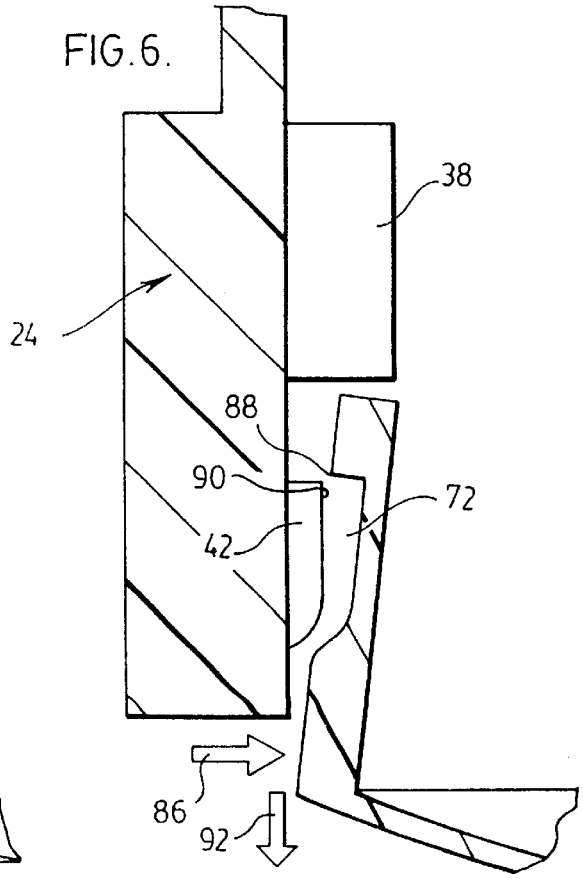
FIG. 6 shows the application of gentle pressure to disengage the detent system of FIG. 5.

As shown in FIG. 5, the respective detents 40 and 42 carry rounded, sloped portions 80 which act as cams to urge the respective grill lips 60 and 64 inwardly when fitting the grill to the hood. The leading edge 82 of the grill engages the sloping portion 80 of the detent to urge the respective lip inwardly. For disassembly, one simply squeezes on the exposed portions 84 of the opposing grill lips 60 and 64. This is shown in more detail in FIG. 6. A gentle squeezing action in the direction of arrows 86 disengage the recess 72 from the detent 42. A similar action occurs with respect to recess 70 disenganging from detent 40. As a result, the edge 88 of the recess 72 clears the internal face 90 of the detent projection 42 to permit removal of the grill from the hood in the direction of arrow 92. The spacing of the stop 38, for example, relative to the leading edge 94 of the grill provides for a slight spacing 96 to permit clearing the edge 94 relative to the stop 38 so that the surfaces do not bind. Hence by way of a gently squeezing action, the grill can be disengaged and removed from the vent hood for service.

There are many significant advantages and features which flow from this type of dryer exhaust vent hood design. The one-way orientation for the grill ensures that the grill is properly installed in the vent hood. Furthermore, the one-way orientation ensures that the user squeezes on the correct sides of the grill. Any attempt to squeeze the curved lower lip 66 will not work because due to the inherent curved nature of the lip, there is extra reinforcement and the grill will not distort in that direction. Suitable printing may be placed on the surface 48 of the hood, directing the consumer to squeeze gently on the edges of the grill; namely lips 60 and 64 to disengage the grill. This facilitates grill removal without having to bent down or kneel down to look under the vent hood. One may simply reach under the vent opening, squeeze the grill lips and disengage the grill form the hood for easy cleaning. Correspondingly, when it is desired to fit the grill back in place, the one-way orientation ensures that the detents line up with the recesses and a proper snap-fitting of the grill back into the hood is achieved. This ensures that the grill is properly fitted into place and avoids any accidental removal of the grill from the hood.

The significantly reinforced perimeter of the hood also ensures that, if one accidentally grasps the hood perimeter, it will not readily squeeze so that the consumer knows that they need to regrip the grill and squeeze it gently for removal. Furthermore, in squeezing the grill lip for removal, the reinforced hood portion will not follow the grill, so that disengagement is ensured. By following the grill, it is meant that there is some friction fitting of the grill to the hood and by squeezing the grill lips inwardly, the reinforced portions of the hood prevent the sides of the hood moving with the grill and instead by pulling on the grill, the frictional engagement is overcome to allow disengagement of the grill from the hood.

Although preferred embodiments of the invention have been described herein in detail, it will be understood by those skilled in the art that variations may be made thereto without departing the spirit of the invention or the scope of the appended claims.

What is claimed is:

1. A clothes dryer exhaust vent comprising:

i) a vent hood having a rear wall for attachment to a building exterior wall, and defining a downwardly projecting rectangular shaped vent opening, said opening being defined in part by a reinforcing flange about hood opening perimeter, said flange having an interior surface about three sides of said opening, the fourth side of said opening being defined by said rear wall, said flange interior having on opposing interior sides stops and detent projections, said rear wall defining said fourth side of said opening and having a downwardly extending ridge, ii) a detachable grill for said vent hood opening which snap fits into said opening by engaging said interior surface of said reinforcing flange, said grill having a three sided perimeter lip for fitment within said reinforcing flange, said fourth side of said grill having a depending lip for mating fit over said ridge of said rear wall, said grill having on opposing lip portion recesses for receiving said detent projections of said hood, said opposing lip portions having rear edges which engage said stops of said hood, said stops being positioned on said hood reinforcing flanges to locate said grill recesses to snap fit with said detents and provide for portions of said grill opposing lips to extend outwardly of said hood flange, said outwardly extending lip portions providing finger grip sections to permit grasping said grill opposing walls and by gentle inward pressure disengage said grill from said hood for cleaning, said grill depending lip matingly engaging said hood ridge providing for one-way fitment of said grill on reinstallation to said hood.

2. The exhaust vent of claim 1 wherein said hood reinforcing flange has a third stop on a third flange portion of said reinforcing flange.

3. The exhaust vent of claim 1 wherein said detent projection has a sloped leading portion to facilitate reinstallation of said grill.

4. The exhaust vent of claim 1 wherein said downwardly projecting ridge has a rounded portion and said grill depending lip is correspondingly rounded for mating fit.

5. The exhaust vent of claim 1 wherein said reinforcing flange resists inward movement when applying inward pressure to disengage said grill to ensure disengagement from said detent projections.

* * * * *